US005761060A

United States Patent [19]

Drew

[11] Patent Number: 5,761,060

[45] Date of Patent: Jun. 2, 1998

[54] SYSTEM AND METHOD FOR EVALUATING SIGN LEGIBILITY

[75] Inventor: John T. Drew, Salt Lake City, Utah

[73] Assignee: University of Utah, Salt Lake City, Utah

[21] Appl. No.: 670,081

[22] Filed: Jun. 25, 1996

[51] Int. Cl.[6] ..... G09F 15/02; G09F 19/22

[52] U.S. Cl. ..... 364/146; 364/130; 364/188; 40/612; 40/582; 395/131; 395/352; 395/961

[58] Field of Search ..... 364/130, 146, 364/188; 40/450, 612, 582, 596; 345/199, 150; 395/131, 352, 961, 974; 358/518; 359/515

[56] References Cited

U.S. PATENT DOCUMENTS

| | | | |
|---|---|---|---|
| 4,295,127 | 10/1981 | Sautter et al. . | |
| 4,395,654 | 7/1983 | Hattori et al. | 313/496 |
| 4,411,529 | 10/1983 | Ingalls et al. | 356/421 |
| 4,461,107 | 7/1984 | Grate | 40/576 |
| 4,507,886 | 4/1985 | Streeter et al. | 40/447 |
| 4,507,888 | 4/1985 | Robinson et al. | 40/621 |
| 4,726,134 | 2/1988 | Woltman | 40/582 |
| 4,736,198 | 4/1988 | Tokuyama et al. . | |
| 5,016,143 | 5/1991 | Aikens | 362/32 |
| 5,050,327 | 9/1991 | Woltman | 40/582 |
| 5,068,809 | 11/1991 | Verheist et al. . | |
| 5,187,570 | 2/1993 | Hibi et al. . | |
| 5,196,953 | 3/1993 | Yeh et al. . | |
| 5,219,217 | 6/1993 | Aikens | 362/32 |
| 5,233,336 | 8/1993 | Byron et al. . | |
| 5,278,670 | 1/1994 | Eschbach | 358/453 |
| 5,303,492 | 4/1994 | Nishio | 40/582 |
| 5,311,212 | 5/1994 | Beretta | 395/131 |
| 5,343,312 | 8/1994 | Hibi et al. | 358/520 |
| 5,442,870 | 8/1995 | Kochanowski | 40/582 |
| 5,452,532 | 9/1995 | Nishio | 40/583 |

FOREIGN PATENT DOCUMENTS

WO94/25951 11/1994 WIPO ..... G09F 13/20

OTHER PUBLICATIONS

Bullock, et al. "Smart diamond Fiber Optic Lane Control", http://www.rsip.lsu.edu/darcy/tti2/tti2.html, pp. 1–2, 1997.

Arizona Department of Transportation "Upcoming Arizona Freeway Sign Update Projects", htto://www.dot.state.az.us/ROADS/traffic/rehabs.html, pp. 1–3, 1997.

Pixymbols Catalog "The Americans with Disabilities Act Symbols v.20", Page Studio Graphics, pp. 1–24, 1987–1997.

Richard C. Moeur, "Manual of Traffic Signs", The State of Arizona Manual of Approved Signs, pp. 1–5, 1997.

Richard C. Moeur, "Standard Sign Typefaces", from the Standard Alphabets for Highway Signs fo Federal Highway Administration, Feb. 5, 1997.

Moeur, "How The Sight Images Were Created", http://members.aol.com./rcmoer/creation.html., Sep. 27, 1997.

Visual Software Solution, "StateCAD Q&A", http://www.statecad.com/scadqa.htm, pp. 1–3, 1997.

"Contrast Dependence of Colour and Luminance Motion Mechanisms in Human Vision", Hawken et al., *Nature*, vol. 367, Jan. 20, 1994, pp. 268–270.

(List continued on next page.)

*Primary Examiner*—Emanuel T. Voeltz
*Assistant Examiner*—Cuong H. Nguyen
*Attorney, Agent, or Firm*—Madson & Metcalf

[57] ABSTRACT

A method and apparatus are disclosed for using information about colors, fonts, and viewing distances to predict the legibility of a sign. The invention takes into account the colors used in the sign, in order to allow the use of many different color combinations while still avoiding "strobing" from simultaneous contrast caused by complementary after-images. A computer program accepts information such as the desired visual acuity, viewer velocity (for signs viewed from a car), font specification, ambient light strength, and the desired typeface color and background color. The program then predicts the legibility of a sign which uses the fonts and colors indicated under the given conditions. Thus, the program may be used to assess the effect of various changes on the sign's legibility without actually rendering or building the sign, installing it, and looking at it.

12 Claims, 10 Drawing Sheets

OTHER PUBLICATIONS

"Craft: A Tool for Customizing Color and Font Selections Guided by Perceptual Rules", Rogowitz et al., *IBM RC,* Oct. 14, 1993, pp. 1–5.

"Discrimination of Colours Presented Against Different Coloured Backgrounds", McFadden, *Color Research and Application,* vol. 17, No. 5, Oct. 1992, pp. 339–351.

"Multiscale Color Image Enhancement", Toet, *Pattern Recognition Letters,* vol. 13, 1992, pp. 167–174.

"Ways of Coloring: Comparative Color Vision as a Case Study for Cognitive Science", Thompson et al., *Behavioral and Brain Sciences,* vol. 15:1, Mar. 1992, pp. 1–75.

"Image Analysis for Advertisement Purposes: a Computational Model of Visual Perception", Gross, *Computer & Graphics,* vol. 16, No. 2, 1992, pp. 213–221.

"Industrial Color Difference: Progess and Problems", Kuehni, *Color Research and Application,* vol. 15, No. 5, Oct. 1990, pp. 261–265.

"Legibility and Subjective Preference for Color Combinations in Text", Pastoor, *Human Factors,* 1990, 32(2), pp. 157–171.

"Chromatic Adaptation on the Minimally Distinct Border and Brightness Matching in Color–Normals and Deuteranopes", Hibino, *Color Research and Application,* vol. 14, No. 3, June 1989, pp. 113–121.

"Selecting Colors for Representing VLSI Layout", Beretta, *Xerox Parc.,* EDL–88–7, Dec. 1988, pp. 1–11.

"Towards the Construction of a Maximally–Contrasting Set of Colours", Van Laar et al., *People and Computers IV,* Sep. 1988, pp. 374–389.

"Color–Defective Vision and Computer Graphics Displays", Meyer et al., *IEEE Computer Graphics & Applications,* 1988, pp. 28–40.

"Color Sequences for Univariate Maps: Theory, Experiments, and Principles", Ware, *IEEE Computer Graphics & Applications,* Sep. 1988, pp. 41–49.

"Visualizing Color Gamuts: A User Interface for the Effective Use of Perceptual Color Spaces in Data Displays", Robertson, *IEEE Computer Graphics & Applications,* Sep. 1988, pp. 50–64.

"Physiological Principles for the Effective Use of Color", Murch, *IEEE Computer Graphics & Applications,* Nov. 1984, pp. 49–54.

"Visibility of Borders: Separate and Combined Effects of Color Differences, Luminance Contrast, and Luminance Level", Frome et al., *Journal of The Optical Society of America,* Feb. 1981, pp. 145–150.

"A Line, Not A Space, Represents Visual Distinctness of Borders Fromed by Different Colors", Tansley et al., *Science,* vol. 191, Mar. 5, 1975, pp. 954–957.

"Effect of Surround and Stimulus Luminance on the Discrimination of Hue", Connors, *Journal of The Optical Society of America,* vol. 54, No. 5, May 1964, pp. 693–695.

ZONE ONE
ZONE THREE

ZONE FOUR
ZONE TWO
ZONE FIVE ZONE SIX

STACKED TYPE readable readable

Under normal reading conditions, reversing black letterforms on a white background to white letterforms on a black background will decelerate the process of reading.

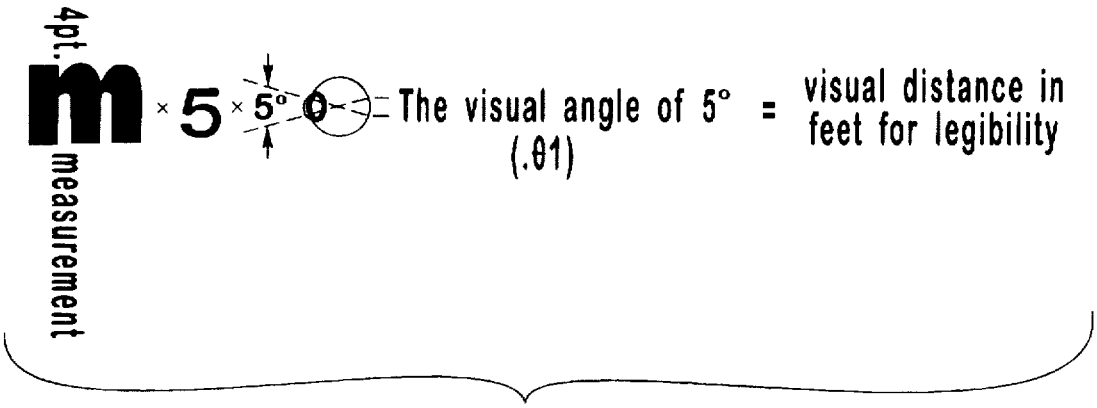
FIG. 12
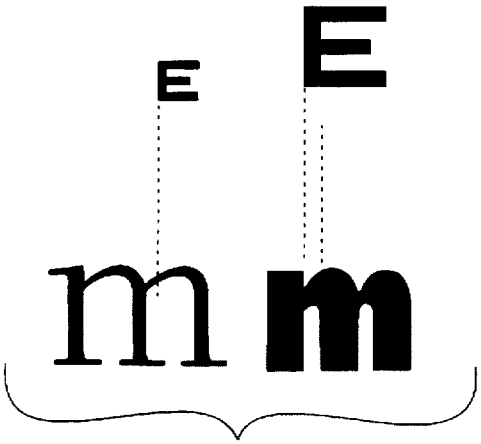
FIG. 13
kerning letters tighter
kerning letters tighter
FIG. 14

SYSTEM AND METHOD FOR EVALUATING SIGN LEGIBILITY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The copyright owner does not hereby waive any of its rights to have this patent document maintained in secrecy, including without limitation its rights pursuant to 37 C.F.R. § 1.14.

This application contains 3 fiches (109 pgs.)

RELATED APPLICATIONS

This application is based on commonly owned copending provisional patent application Ser. No. 60/000,541 filed Jun. 27, 1995, entitled EFFECTS OF DISTANCE, TYPOGRAPHIC FORMS, COLOR, AND MOTION ON VISUAL ACUITY ("'541 application"), which is incorporated herein by reference. The above copyright notice also applies to said incorporated material.

FIELD OF THE INVENTION

The present invention relates to evaluation of the effects of distance, typographic forms, color, and motion on the legibility of signs, and more particularly to a system and method for using information about colors, fonts, and viewing distances to predict the legibility of a sign to a person having a specified visual acuity.

TECHNICAL BACKGROUND OF THE INVENTION

Signs are widely used to direct traffic, advertise products and services, identify businesses and other institutions, and to generally inform, amuse, or caution their viewers. However, designing a sign that is legible under the expected viewing conditions is not a straightforward task. Font styles, font sizes, type and background colors, viewing distance, lighting, and the time available to read the sign may all impact the sign's legibility. Moreover, there is an enormous number of possible combinations of particular values for these and other important characteristics of any given sign configuration.

Some efforts have been made to identify general guidelines that tend to produce legible signs. These efforts draw on the fields of visual perception, visual acuity testing, and pattern recognition, among others. However, reliance on general guidelines inhibits experimentation and unnecessarily removes from consideration possible sign configurations that lie outside the domain defined by the guidelines but nevertheless provide acceptable legibility. Moreover, many of these efforts assume a world containing only black, white, and shades of grey, so they provide little help in designing legible color signs.

Thus, it would be an advancement in the art to provide an improved system and method for evaluating possible sign configurations.

Because signs are expensive and time-consuming to fabricate, it would also be an advancement to provide such a system and method which reduces the need for sign fabrication in order to test the legibility of a specified sign configuration.

It would be a further advancement in the art to provide such a system and method which is helpful in designing color signs.

Such a system and method are disclosed and claimed herein.

BRIEF SUMMARY OF THE INVENTION

The present invention provides a system and method for determining the likely legibility of signs under specified conditions without fabricating a sign at the intended site from wood, metal, paint and similar materials. This can substantially reduce the cost of sign fabrication and alteration, and also encourages sign designers to try alternative designs that may improve legibility, provide greater consistency with other signage, or enhance the aesthetic appeal of the sign.

In one embodiment the invention comprises a computer program and charts referenced by the program. A program user enters information such as the desired visual acuity, viewer velocity (for signs viewed from a car), font specification, ambient light strength, reflection characteristics, and desired typeface color and background color. The entered information collectively defines a "sign configuration."

The program then transforms the sign configuration characteristics and selected information from the charts into a format that specifies an optimal viewing distance, thereby permitting evaluation of the sign's legibility under the specified conditions. This evaluation is used during an iterative design process as a predictor of the legibility of a specified sign that uses the fonts and colors indicated under the given conditions. Based on the prediction, the user may elect either to alter the specified characteristics or to fabricate signage according to those characteristics. In short, the invention may be used to assess the effect of various changes on the sign's legibility without actually rendering or building the sign, installing it, and viewing it.

The features and advantages of the present invention will become more fully apparent through the following description and appended claims taken in conjunction with the accompanying drawings.

BRIEF DESCRIPTION OF THE DRAWINGS

To illustrate the manner in which the advantages and features of the invention are obtained, a more particular description of the invention summarized above references the appended drawings. The parenthetical page number in each brief description indicates the page at which the drawing is found in the '541 application. Understanding that these drawings only provide selected embodiments of the invention and are not therefore to be considered limiting of its scope, the invention is described and explained with additional specificity and detail through the use of the accompanying drawings in which:

FIG. 12 shows an application of Snellen's approach to provide a legibility indication.

FIG. 13 shows examples of letterforms having corresponding thinnest part values.

FIG. 14 shows two examples of the effects of different kerning values.

DETAILED DESCRIPTION OF THE PREFERRED EMBODIMENTS

Figure 1:
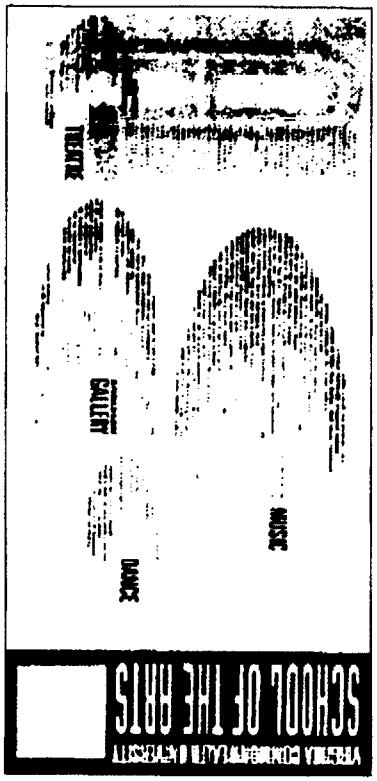
FIG. 1 is a diagram showing the placement of a sign on a poster and the flow of foot traffic past the sign.
Figure 2:
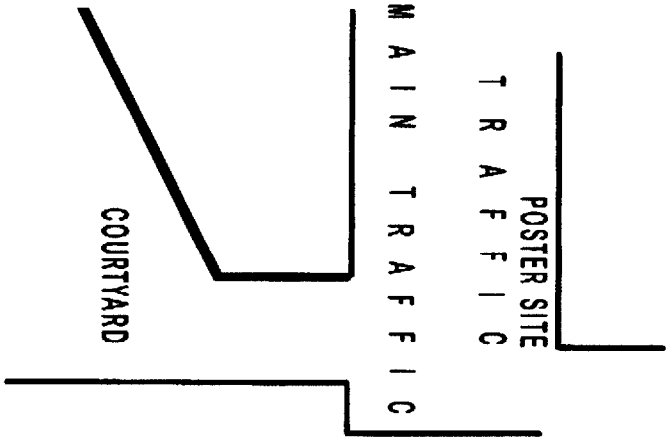
FIG. 2 shows the sign referred to in FIG. 1.
Figures 3, 4, 5, 6, 7:
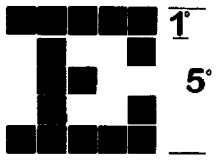
FIG. 3 shows selected zones in the sign referred to in FIG. 1.
FIG. 4 shows an example of stacked type.
FIG. 5 shows two examples of rotated type.
FIG. 6 shows an example of slanted type using reversed letterforms.
FIG. 7 shows a Snellen letterform.
Figure 8:
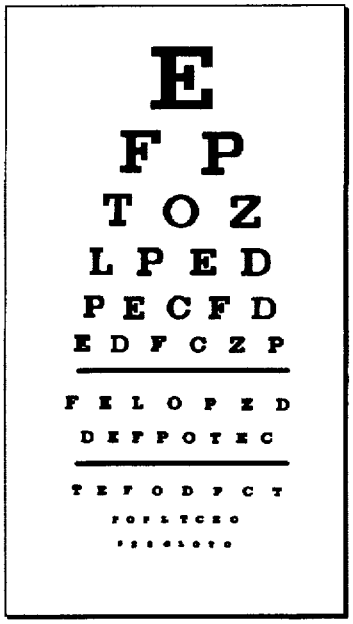
FIG. 8 shows a Snellen visual acuity testing sign.
Figure 9:
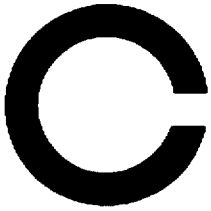
FIG. 9 shows a Landolt ring visual acuity testing sign.
Figure 10:
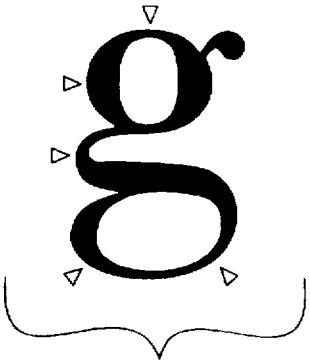
FIG. 10 shows locations of convergence in an example letterform.
Figure 11:
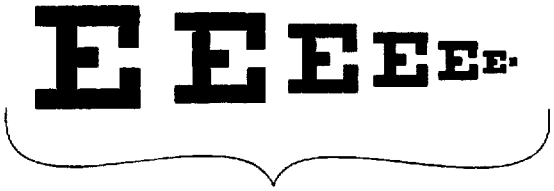
FIG. 11 shows a mono weight typeface viewed at different distance values.
Figure 15:
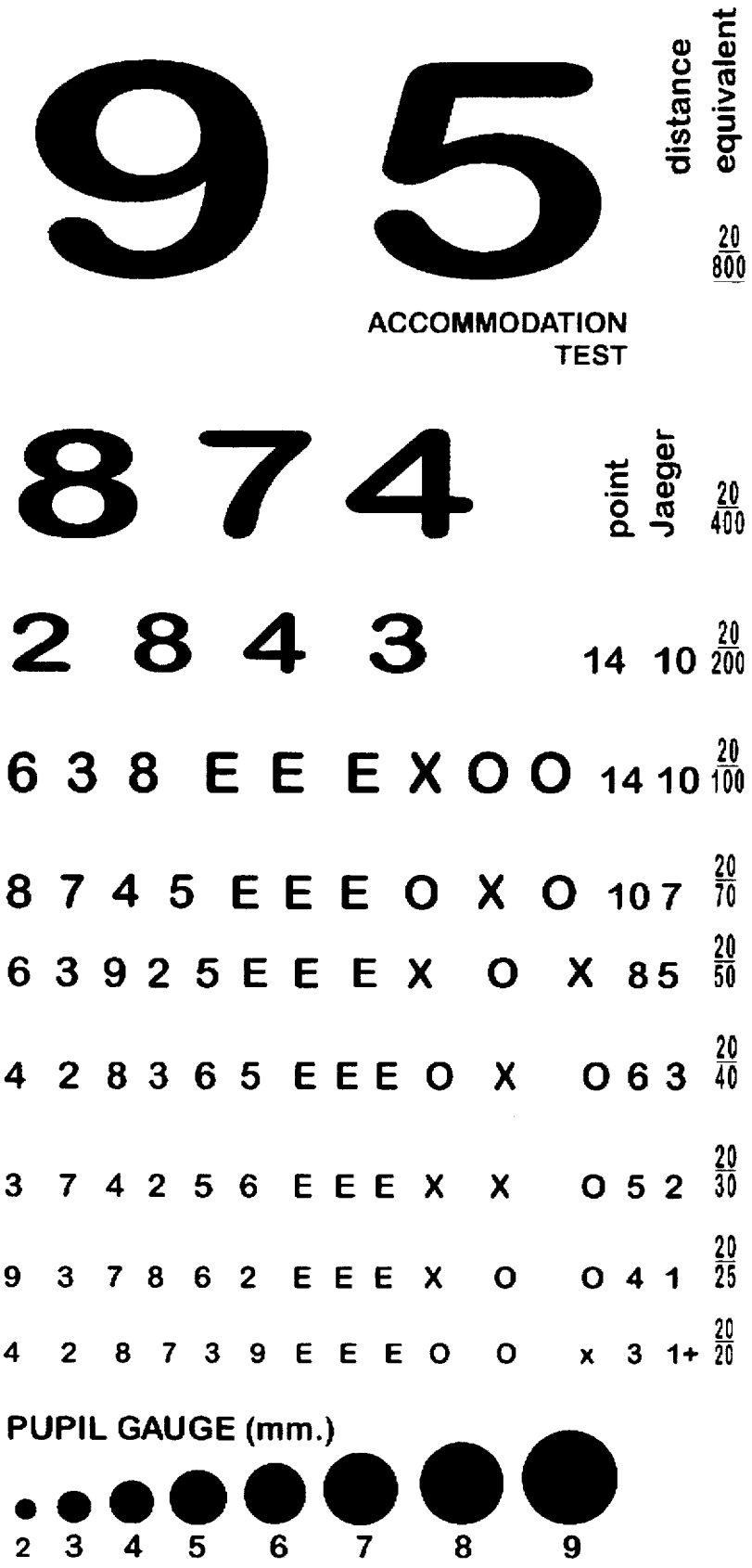
FIG. 15 shows a Rosenbaum visual acuity testing sign.
Figure 16:
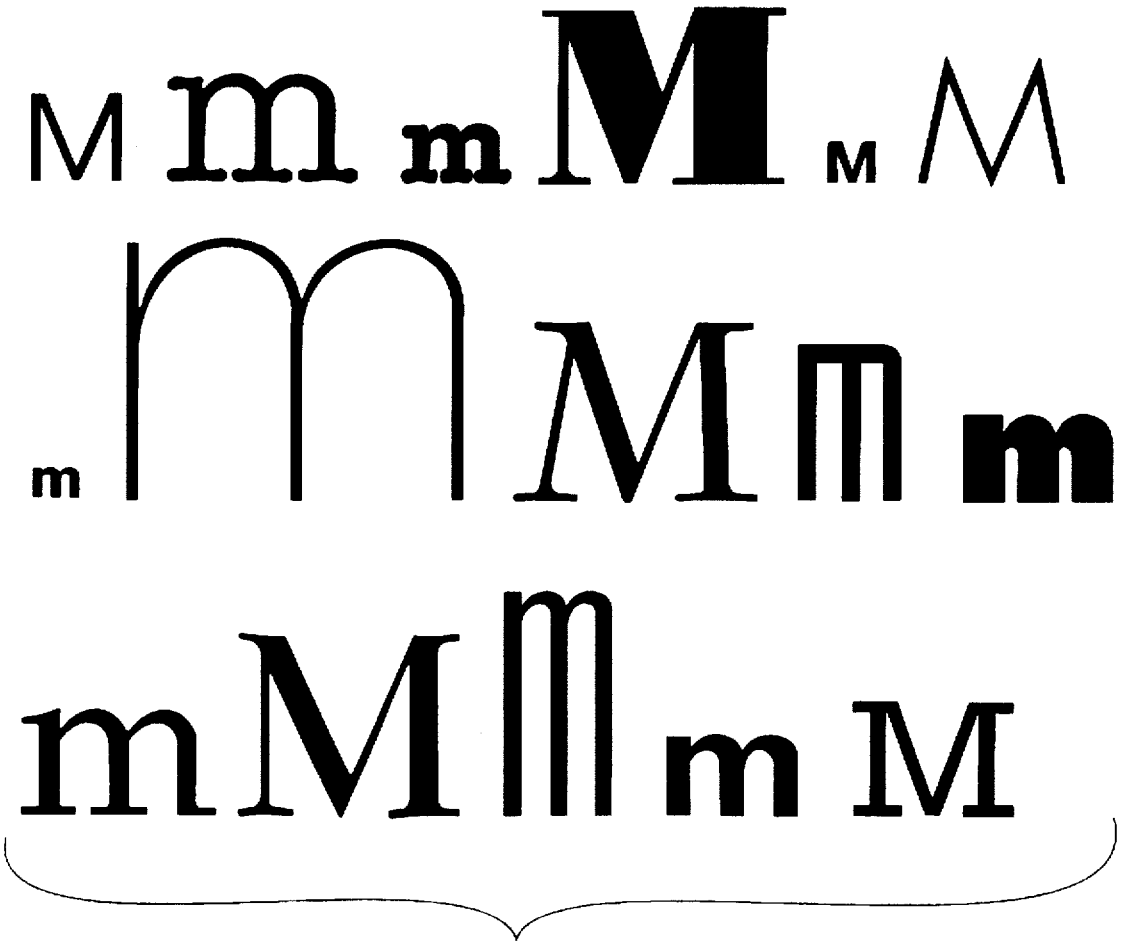
FIG. 16 shows example letterforms for use in testing the practical effects of Snellen's approach.
Figure 17:
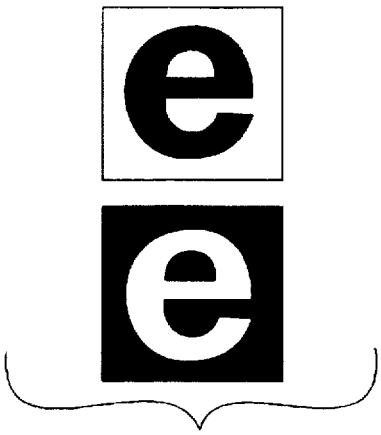
FIG. 17 shows a letterform in its positive and reversed states.
Figure 18:
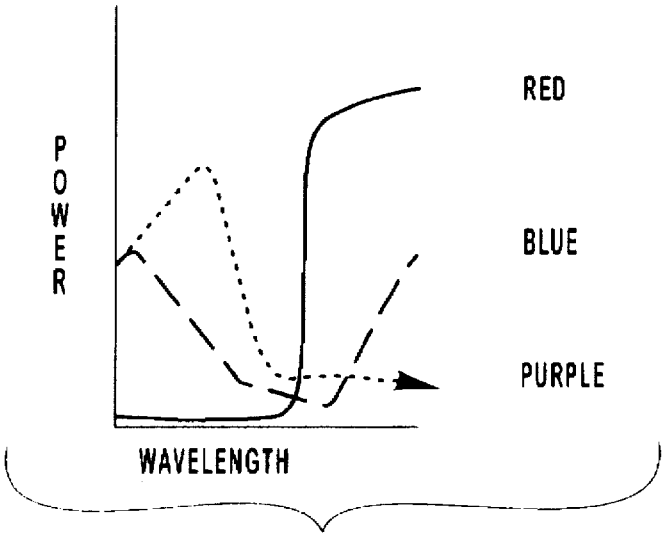
FIG. 18 shows a spectral power distribution curve for a light source.
Figure 19:
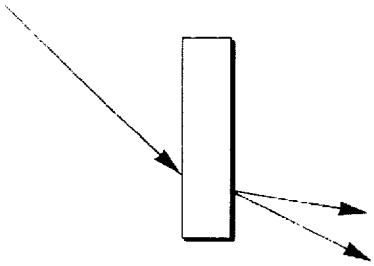
FIG. 19 is a diagram showing refraction of a beam of light.
Figure 20:
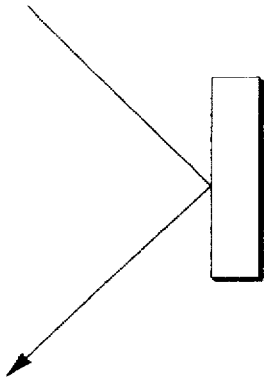
FIG. 20 is a diagram showing reflection of a beam of light.
Figure 21:
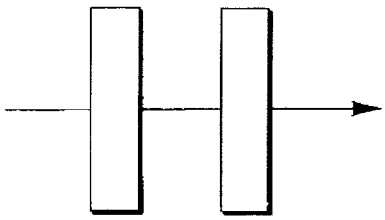
FIG. 21 is a diagram showing absorption of a beam of light.
Figure 22:
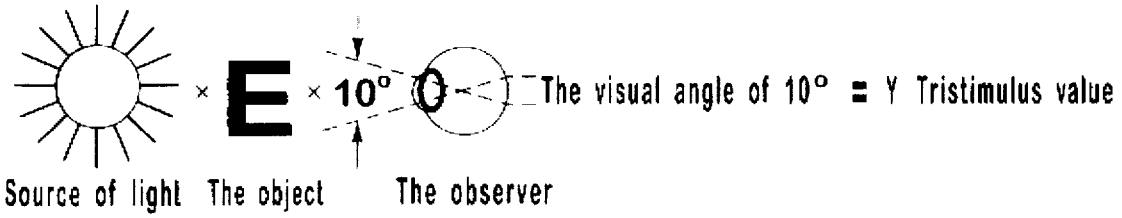
FIG. 22 shows an application of the tristimulus approach to provide a legibility indication.
Figure 23:
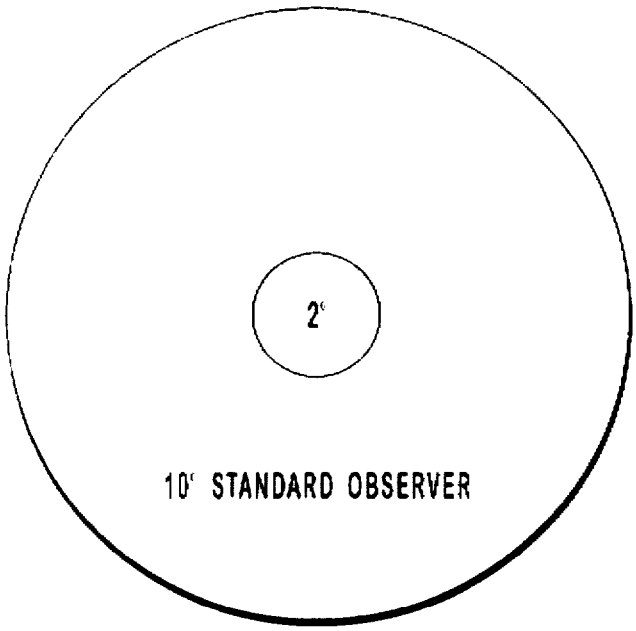
FIG. 23 shows a diagram illustrating two different angles of vision.
Figure 24:
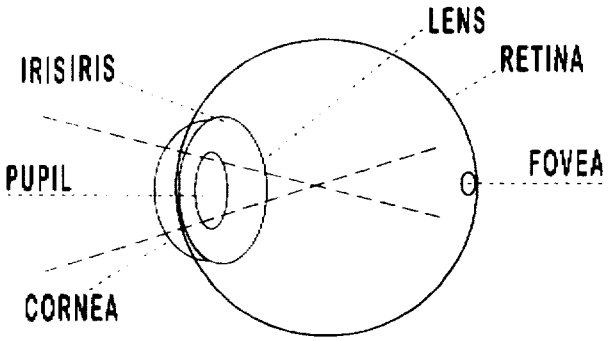
FIG. 24 shows a cross-sectional diagram illustrating eye anatomy.
Figure 25:
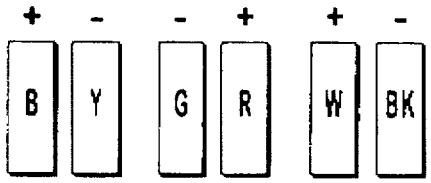
FIG. 25 shows a diagram illustrating receptor pairs in the eye.
Figure 26:
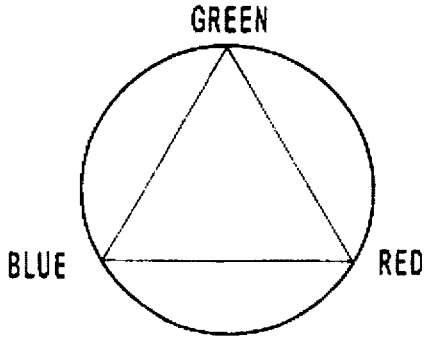
FIG. 26 shows a diagram illustrating an additive color wheel.
Figure 27:
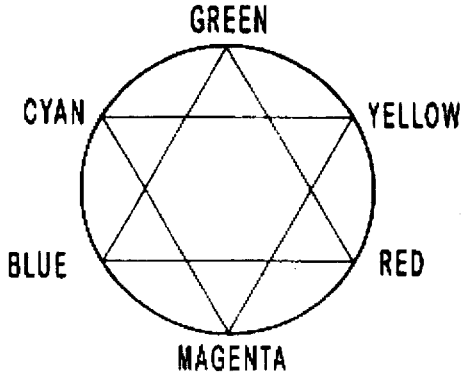
FIG. 27 shows a diagram illustrating a subtractive color wheel.
Figure 28:
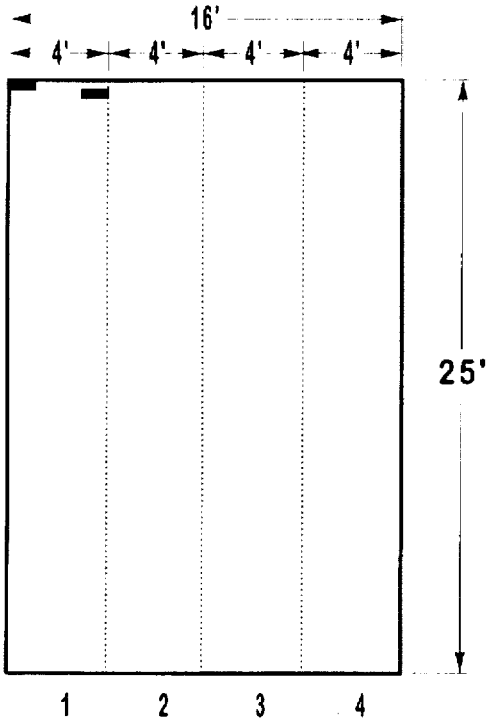
FIGS. 28 and 29 show plots summarizing the results of measuring legibility indicators for selected color sign configurations.
Figure 29:
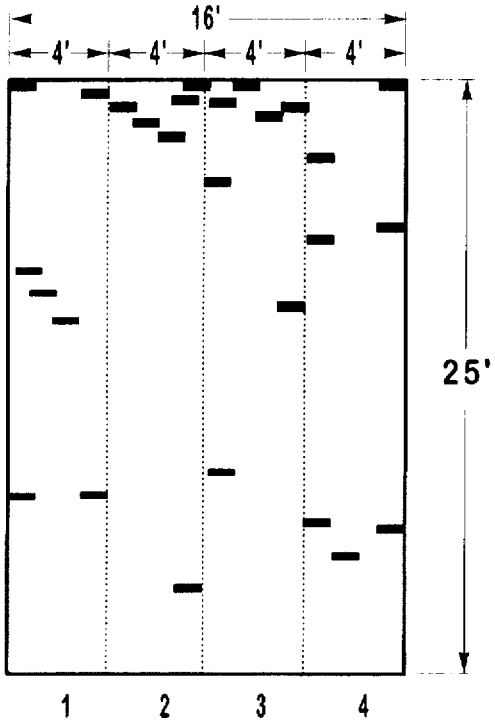
Figure 30:
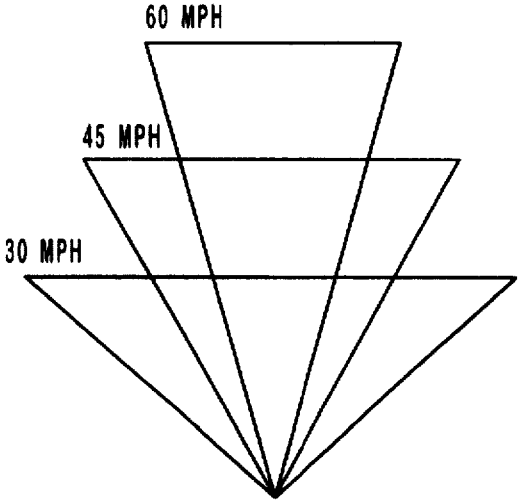
FIG. 30 shows a diagram illustrating the relationship between velocity and peripheral vision.

The present invention relates to a method and apparatus for determining the likely legibility of a sign under specified conditions without fabricating the sign, and for improving the accuracy of such determinations based on measurements made using fabricated signs. One embodiment of the invention comprises a computer program including a user interface in signal communication with a keyboard and a display device to permit communication between a human user and a state machine constructed in computer memory. The user interface and a state machine controller may be implemented in BASIC, C, C++, assembly, or other code executing on a laptop, desktop, palmtop, workstation, or mainframe computer operating under DOS, UNIX, Windows or another operating system. The display device includes a computer monitor.

The computer includes a memory such as a random access memory ("RAM"). The memory is one example of a "data store," also known as a "computer-readable medium." Other familiar data stores include, without limitation, magnetic hard disks, magnetic floppy disks, optical disks, CD-ROM disks, and magnetic tape. Each such data store includes a substrate such as a magnetic material which is capable of storing data in physical form. According to the present invention, the substrate of the memory is given a specific physical configuration that causes the computer to operate in the manner taught herein.

Visual acuity of the viewer is initially assumed to be 20/20 vision but other visual acuities may be specified by the user. The font specification typically includes a font choice (e.g., Helvetica), the font's point size, options such as "bold" or "italic", and information about spacing and kerning.

Unlike many conventional approaches to creating legible signs, the present invention takes into account the colors used in the sign, in order to allow the use of many different color combinations while still avoiding "strobing" from simultaneous contrast caused by complementary afterimages. In particular, the invention produces legible color combinations which have substantially lower percentage contrasts in the color Y tristimulus values (a.k.a. "spectral luminous efficiency" values) than conventional signs. Signs produced according to the invention have contrast values of at least 6% and preferably 10–20%, rather than a conventional value which may be as much as 70% or more.

According to one method of the invention, the optimal viewing distance is determined by measuring the thinnest part of the desired letterform (or counter form if it is smaller than the breadth of the letterform lines), multiplying that by a factor of five (based on Snellen's approach), multiplying by a visual acuity factor, multiplying by a Y tristimulus value for the desired color and lighting, and then multiplying by a reflectance characteristic value (under glass=0.10, otherwise 1.0). The resulting distance can then be evaluated according to the viewer's reaction time to take viewer velocity into account. Suitable visual acuity factors include:

| | |
|---|---|
| Legally Blind | 0.08 |
| 20/100 | 0.16 |
| Visually Impaired | 0.23 |
| 20/50 | 0.33 |
| 20/40 (DMV) | 0.395 |
| 20/30 | 0.53 |
| 20/25 | 0.79 |
| 20/20 (Normal) | 0.81 |

Additional details describing the invention are set forth in the '541 application and incorporated herein by reference. It will be appreciated that the charts provided in the '541 application, as well as similar charts for other typefaces, distances, font heights, or visual acuities, are readily placed in a computer-readable form accessible to the state machine and controller of the implementing program to provide a means for associating signage letter heights, viewing distances, and type faces according to their combined effect on sign legibility.

Appendix A of the present application contains C++ source code illustrating one implementing program according to the present invention.

Appendix B contains additional Y tristimulus values for colors not listed in the '541 application.

Appendix C contains a list of font specifications indicating which specifications comply with the Americans with Disabilities Act.

Although particular methods embodying the present invention are expressly illustrated and described herein, it will be appreciated that apparatus and article embodiments may be formed according to methods of the present invention. Unless otherwise expressly indicated, the description herein of methods of the present invention therefore extends to corresponding apparatus and articles, and the description of apparatus and articles of the present invention extends likewise to corresponding methods.

The invention may be embodied in other specific forms without departing from its essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A computer-implemented method for evaluating the legibility of a sign configuration, the method comprising the steps of:

(a) constructing in computer memory a sign configuration state machine, the state machine including slots for receiving and holding signals corresponding to predetermined viewing distance, font, ambient light, typeface color and background color characteristics of the sign configuration, the state machine also including a controller for retrieving signals from the slots and transmitting signals to the slots to thereby effect state transitions;

(b) computing a legibility indication for the sign configuration utilizing the state machine; and (c) transmitting to a display device signals corresponding to the computed legibility indication.

2. The method of claim 1, wherein said step of constructing a state machine further comprises the step of allocating slots for signals corresponding to the visual acuity of a viewer.

3. The method of claim 1, wherein said step of constructing a state machine further comprises the step of allocating a slot for a signal corresponding to the velocity of a viewer relative to a sign in the sign configuration.

4. The method of claim 1, wherein said step of computing a legibility indication comprises the steps of:

retrieving signals from a plurality of slots allocated in computer memory;

calculating a preliminary legibility indication for the sign configuration at the predetermined viewing distance;

repeating said retrieving and calculating steps a plurality of times while substituting different viewing distances for the predetermined viewing distance in said calculating step; and merging the resulting plurality of preliminary legibility indications to obtain the legibility indication that is utilized in said transmitting step.

5. The method of claim 1, further comprising the step of fabricating a sign having font, typeface color, and background color characteristics corresponding to the signals held in slot in the state machine.

6. The method of claim 5, wherein the fabricated sign has a contrast value of at least six percent but less than seventy percent.

7. The method of claim 5, wherein the fabricated sign has a contrast value of in the range from about ten percent to about twenty percent.

8. A method for evaluating a sign configuration comprising the steps of:

(a) fabricating a sign at a predetermined location, the sign being fabricated according to predetermined font values;

(b) positioning a viewer at a distance from the fabricated sign specified by a predetermined distance value;

(c) measuring the ambient light on the fabricated sign to thereby obtain a measured light value;

(d) evaluating the legibility of the fabricated sign to the positioned viewer under the measured light condition to obtain a measured legibility indication;

(e) constructing a state machine in a computer memory, the state machine including state signals which correspond to viewing distance, font, and light characteristics of a sign configuration;

(f) running the state machine to thereby obtain a computed legibility indication based on the state signals; and (g) analyzing the computed legibility indication and the measured legibility indication to obtain an assessment.

9. The method of claim 8, wherein the values referenced in steps (a), (b), and (c) are termed "fabricated configuration values," wherein said running step comprises providing the state machine with signals corresponding to the fabricated configuration value characteristics but differing in value from the fabricated configuration values in at least one characteristic, and said analyzing step produces an assessment of the impact the difference in value would have on the measured legibility indication if the difference in value were reflected in the sign configuration containing the fabricated sign.

10. The method of claim 8, wherein said running step comprises providing the state machine with signals corresponding to the font values for the fabricated sign, the distance value for the positioned viewer, and the measured ambient light value, and said analyzing step produces an assessment of the accuracy of the computed legibility indication with respect to the measured legibility indication.

11. A computer-based system for evaluating a sign configuration, said system comprising:

means for associating signage letter heights, viewing distances, and type faces according to their combined effect on sign legibility;

a keyboard for generating signals corresponding to predetermined color characteristics of the sign configuration;

a sign configuration state machine in computer memory, the state machine including slots for receiving and holding signals corresponding to predetermined color characteristics of the sign configuration, the state machine also including signal generators for generating signals transmittable to the slots to thereby effect state transitions; and a display for displaying values corresponding to state machine signals.

12. The system of claim 11, wherein said means comprise charts stored in a computer-readable medium.

* * * * *